US007341249B2

(12) United States Patent
Ohtsuka et al.

(10) Patent No.: US 7,341,249 B2
(45) Date of Patent: Mar. 11, 2008

(54) SHEET HOLDING APPARATUS AND IMAGE FORMING SYSTEM

(75) Inventors: Masaru Ohtsuka, Hachioji (JP); Tomoya Motoyoshi, Hachioji (JP); Tomohiro Kiriyama, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 278 days.

(21) Appl. No.: 10/961,433

(22) Filed: Oct. 7, 2004

(65) Prior Publication Data

US 2005/0218588 A1 Oct. 6, 2005

(30) Foreign Application Priority Data

Mar. 31, 2004 (JP) ..... 2004-106378

(51) Int. Cl.
*B65H 31/24* (2006.01)

(52) U.S. Cl. ..... 271/298; 271/213

(58) Field of Classification Search ..... 271/292–294, 271/298, 213; 270/58.14, 58.15, 58.19
See application file for complete search history.

(56) References Cited

U.S. PATENT DOCUMENTS

| | | | | |
|---|---|---|---|---|
| 6,416,052 | B2 * | 7/2002 | Yamada et al. | 271/292 |
| 6,988,728 | B2 * | 1/2006 | Kida | 271/292 |
| 2001/0002078 | A1 * | 5/2001 | Kakigi | 271/292 |

* cited by examiner

*Primary Examiner*—Patrick Mackey
*Assistant Examiner*—Jeremy Severson
(74) *Attorney, Agent, or Firm*—Squire, Sanders & Dempsey L.L.P.

(57) ABSTRACT

A sheet holding apparatus having: a feeding mechanism to feed a sheet on which an image is formed by an image forming apparatus, from a predetermined feeding position; a tray section having a tray to contain the sheet fed through the feeding mechanism; an initialization mechanism to initialize the tray section; and a control section to make a determination about necessity or unnecessity of an initialization of the tray section and/or a content of the initialization on the basis of information about a position of the tray, which is notified from the image forming apparatus, and to control the initialization of the tray section through the initialization mechanism according to the determination.

4 Claims, 7 Drawing Sheets

SHEET HOLDING APPARATUS AND IMAGE FORMING SYSTEM

BACKGROUND OF THE INVENTION

1. Field of the Invention

The present invention relates to a sheet holding apparatus for holding in a tray a sheet (e.g., a paper, an OHP sheet, and so on) whereon an image is generated by an image forming apparatus such as a printer, a copy machine, a facsimile machine, or a multifunction apparatus having functions of at least two of the above apparatus; and an image forming system comprising the sheet holding apparatus and the image forming apparatus.

2. Description of Related Art

In general, a single or an array of trays are set up in a sheet holding apparatus to hold a sheet. When holding in the sheets with the trays being controlled to move up and down, an initialization operation is carried out, on turning on electric power, or at the beginning of an image formation, to move the trays to an initialization position or a desirable position. The initialization operation is carried out in such a way that the trays, while in temporary up-and-down operation, are detected by a sensor, and then are moved up and down for a time period which matches the distance between a sensor and the initialization position or the desirable position after being detected by the sensor. However, the initialization operation suffers from shortcomings such as the operation is too long and too noisy.

Conventionally, a sheet holding apparatus is provided with, for example, 7 upper trays and 7 lower trays, in total 14 layers of trays. When the trays to be used are the 7 upper trays, in other words, when the number of copies set by an operator from the operation panel of the apparatus is 5 and a sort operation is chosen, the sheet holding apparatus determines it is sufficient to initialize only the 7 upper trays, and then choose the 7 upper trays to move up and down so as to identify the position by a sensor (e.g. refer to paragraphs [0214]-[0223] and FIG. 35 of JP-Tokukaihei-09-73251, hereafter referred as reference 1 in which the term of bin is used to refer to the term of tray which is used in the present application for holding an outputted sheet).

However, in the case of the reference 1, only the necessary trays (bins) corresponding to the number of copies of the sheets whereon an image is to be formed need to be initialized, so the initialization of the trays to be used is always moved to pass the same distance, the aforementioned shortcomings are not solved.

SUMMARY OF THE INVENTION

In view of the aforementioned problems, an object of the invention is to provide an improved sheet holding apparatus and an improved image forming system which employs the sheet holding apparatus.

Another object of the present invention is to provide a sheet holding apparatus and an image forming system employing the same, which aim at shortening the initialization time.

Still another object of the present invention is to provide a sheet holding apparatus and an image forming system employing the same, which aim at reducing noise during the initialization.

Main terms are defined hereinbelow.

Initialization refers to that on turning on electric power or before an image is formed (e.g. just after a start button is pushed down which gives an instruction to begin the image formation, but before an image is actually formed), a specified tray (or a tray which is determined in advance) is placed to a predetermined position or the feeding position to which a sheet whereon an image has been formed is fed. And when placing the tray requires moving up and down the tray, the movement is also included in initialization. Moving up and down can refer to a unidirectional movement either moving up or moving down, or refer to a bi-directional movement of moving up and down in time sequence. Information about tray position refers to identification information for specifying the tray which is placed in a predetermined position, for example, the feeding position and unspecified information showing that the tray cannot be specified. The unspecified information is information which can determine that the tray placed in the predetermined position cannot be specified or identified, or is information which can determine that none of the trays is situated in the predetermined position. For operational convenience, information other than the tray identification information may be assumed unspecified information. In addition, information about tray position may sometimes contain the position (or distance) information of the tray. For example, when only one tray is present, the position (or distance) information, with respect to the predetermined position (e.g. the feeding position), is information about the tray position.

In view of the aforementioned problems, a sheet holding apparatus according to a first aspect of the invention comprises: a feeding mechanism to feed a sheet on which an image has been formed by an image forming apparatus, from a predetermined feeding position; a tray section having a tray to hold the sheet fed through the feeding mechanism; an initialization mechanism to initialize the tray section; and a control section to make a determination about necessity or unnecessity of an initialization of the tray section and/or a content of the initialization on the basis of information about a position of the tray, which is notified from the image forming apparatus, and to control the initialization of the tray section through the initialization mechanism according to the determination.

Preferably, the initialization mechanism further comprises an up-and-down mechanism to move up and down the tray section, and the initialization is performed by moving up and down the tray section through the up-and-down mechanism.

Preferably, the tray section comprises a plurality of trays; and a content of the initialization includes a first initialization to move up and down the tray section by a first distance, and a second initialization to move up and down the tray section by a second distance; when the information about the position of the tray is information about none of the plurality of trays, the control section determines the first initialization as the content of the initialization, and controls the initialization mechanism in such a way that the tray section is moved up and down by the first distance.

Preferably, the holding apparatus further comprises a sensor for detecting a position of the tray section, wherein the first distance of the first initialization is a distance covered by the tray section moved up and down to reach a predetermined position after the sensor detects the tray section.

Preferably, the tray section comprises a plurality of trays, a content of the initialization includes a first initialization to move up and down the tray section by a first distance and a second initialization to move up and down the tray section by a second distance which is smaller than the first distance, and when the information about the position of the tray provides information for one of the plurality of trays, the control section determines the second initialization as a content of the initialization, and controls the initialization mechanism in such a way that the tray section is moved up and down by the second distance.

Preferably, the tray section comprises a plurality of trays, and the information about the position of the tray shows that a tray is in a position corresponding to the predetermined feeding position or shows that a tray is not in a position corresponding to the predetermined feeding position.

Preferably, the tray section comprises a plurality of trays, and the information about the position of the tray is information about one of the plurality of trays or information about none of the plurality of trays.

Preferably, the control section determines that the initialization is unnecessary when the information about the position of the tray provides information for any one of the plurality of trays, and determines that the initialization is necessary when the information about the position of the tray provides for none of the plurality of trays.

Preferably, the information about one of the plurality of trays shows that a tray is in a position corresponding to the predetermined feeding position, and the information about none of the plurality of trays shows that a position of the tray section is unknown.

Preferably, the control section is notified the information about the position of the tray by the image forming apparatus when electric power is turned on; on image formation, when receiving a designation of a holding destination tray of a sheet on which an image is formed, the control section determines whether the information about one of the plurality of trays is present in the information about the position of the tray when electric power is turned on, and when the information about one of the plurality of trays is present, the control section makes a determination about whether the information about one of the plurality of trays is consistent with the designated holding destination tray, and when a result of the determination is inconsistence, the control section controls the initialization mechanism after determining that, as a content of an initialization, the designated holding destination tray of a sheet is controlled so as to be situated in a sheet feeding position.

Preferably, the control section, when the information about the position of the tray is determined to be the information about none of the plurality of trays, controls the initialization mechanism in such a way that an initialization which includes operation for detecting a position of the tray section is carried out.

Preferably, the control section, when determining that the information about the position of the tray is consistent with the holding destination tray, determines that an initialization is unnecessary and the initialization mechanism is not activated to carry out an initialization.

Preferably, the control section, when determining that the information about the position of the tray is consistent with the holding destination tray, controls the initialization mechanism in such a way that the designated holding destination tray is temporarily moved from the feeding position and again situated in the feeding position.

BRIEF DESCRIPTION OF THE DRAWINGS

The invention will become more fully understood from the detailed description given hereinbelow and the accompanying drawings which are given by way of illustrating only, and thus are not intended as a definition of the limits of the invention, and wherein;

FIG. 3 illustrates an initialization flow chart after electric power is turned on;

FIG. 4 illustrates an initialization flow chart after the copy switch is turned on;

FIG. 6 illustrates other exemplary initialization flow chart after the copy switch is turned on.

DETAILED DESCRIPTION OF THE PREFERRED EMBODIMENTS

Figure 1A:
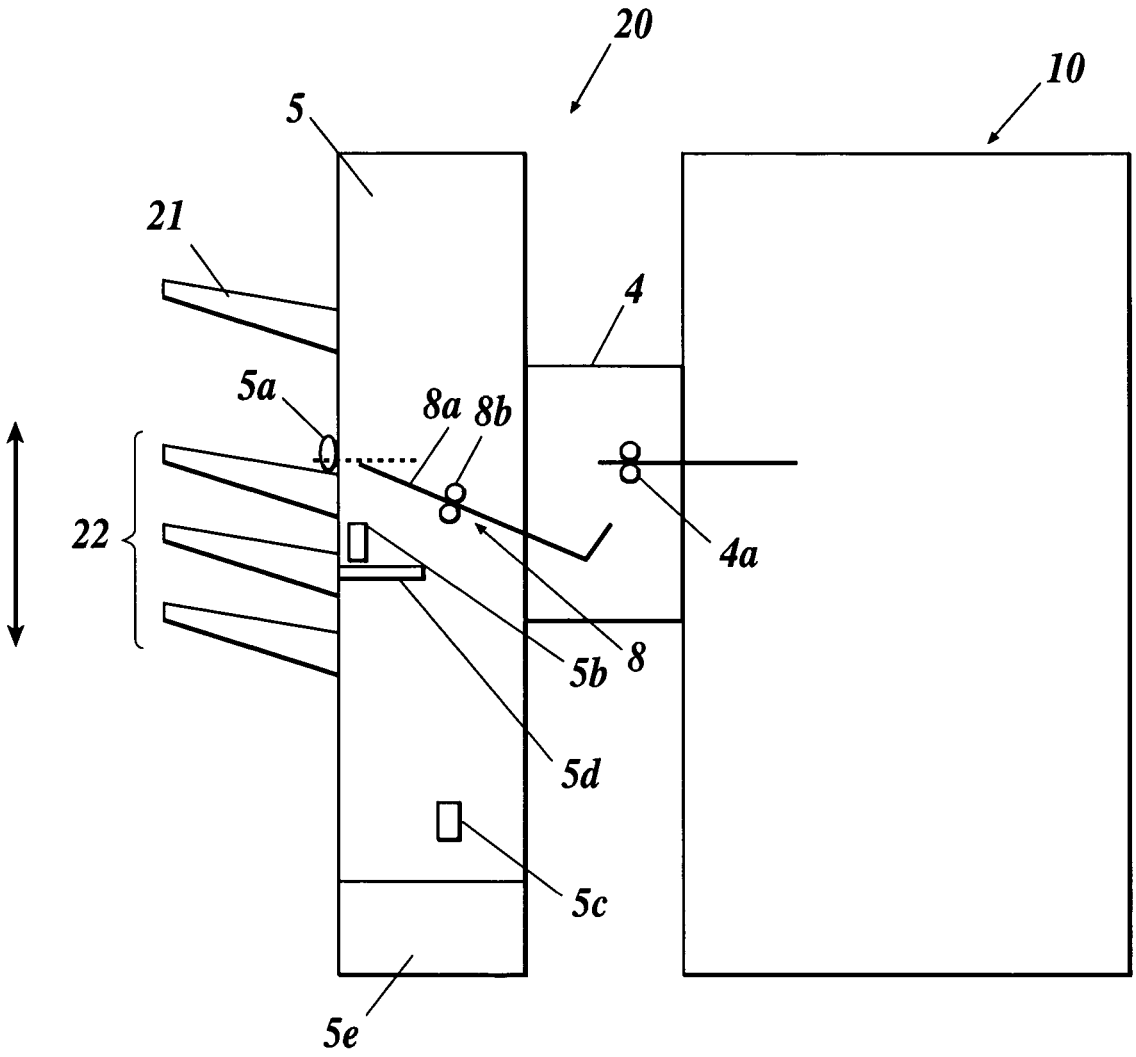
FIG. 1A illustrates a configuration of the image forming system of the first embodiment.
Figure 1B:
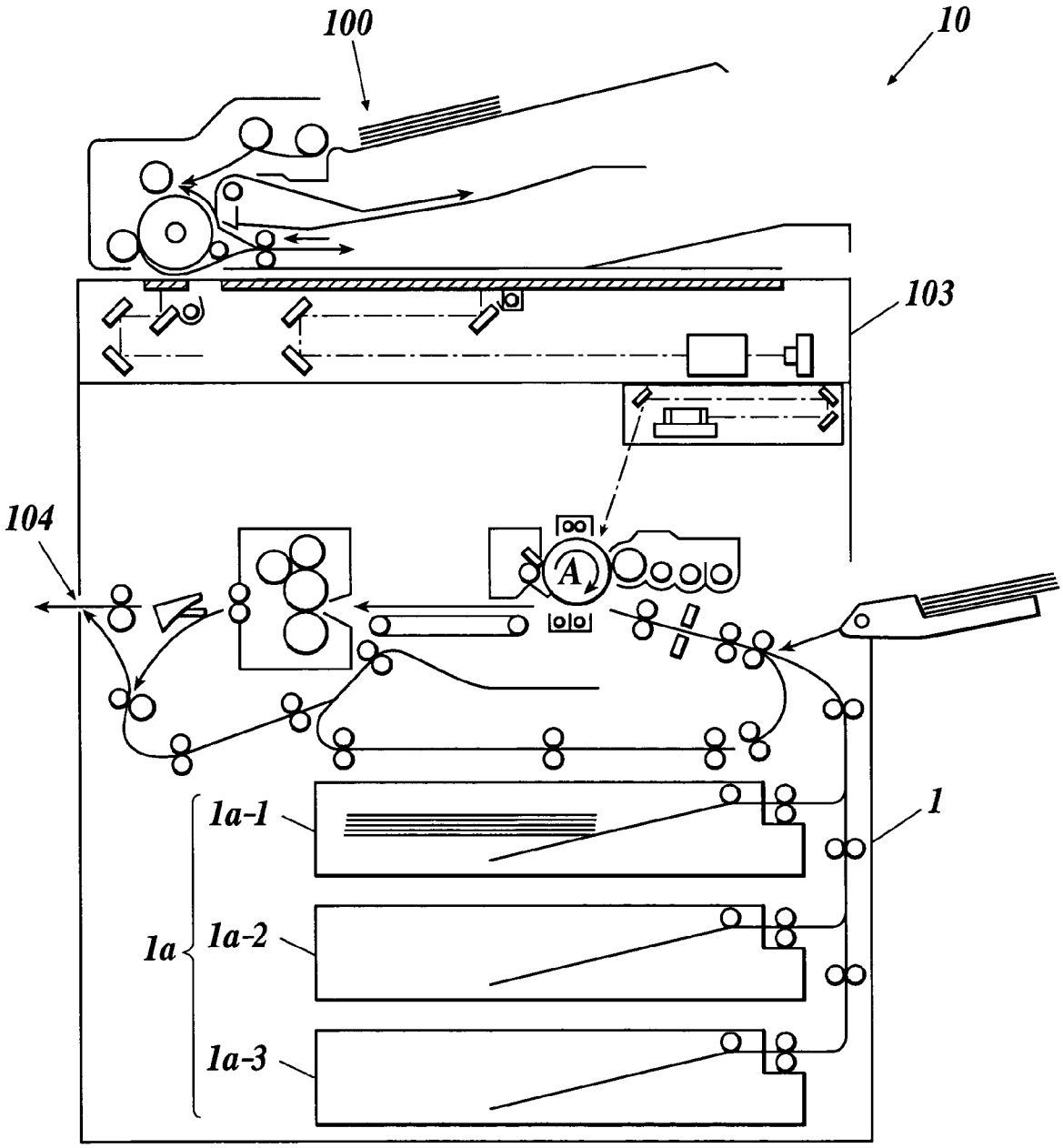
FIG. 1B illustrates the configuration of the image forming apparatus 10.
Figure 2:
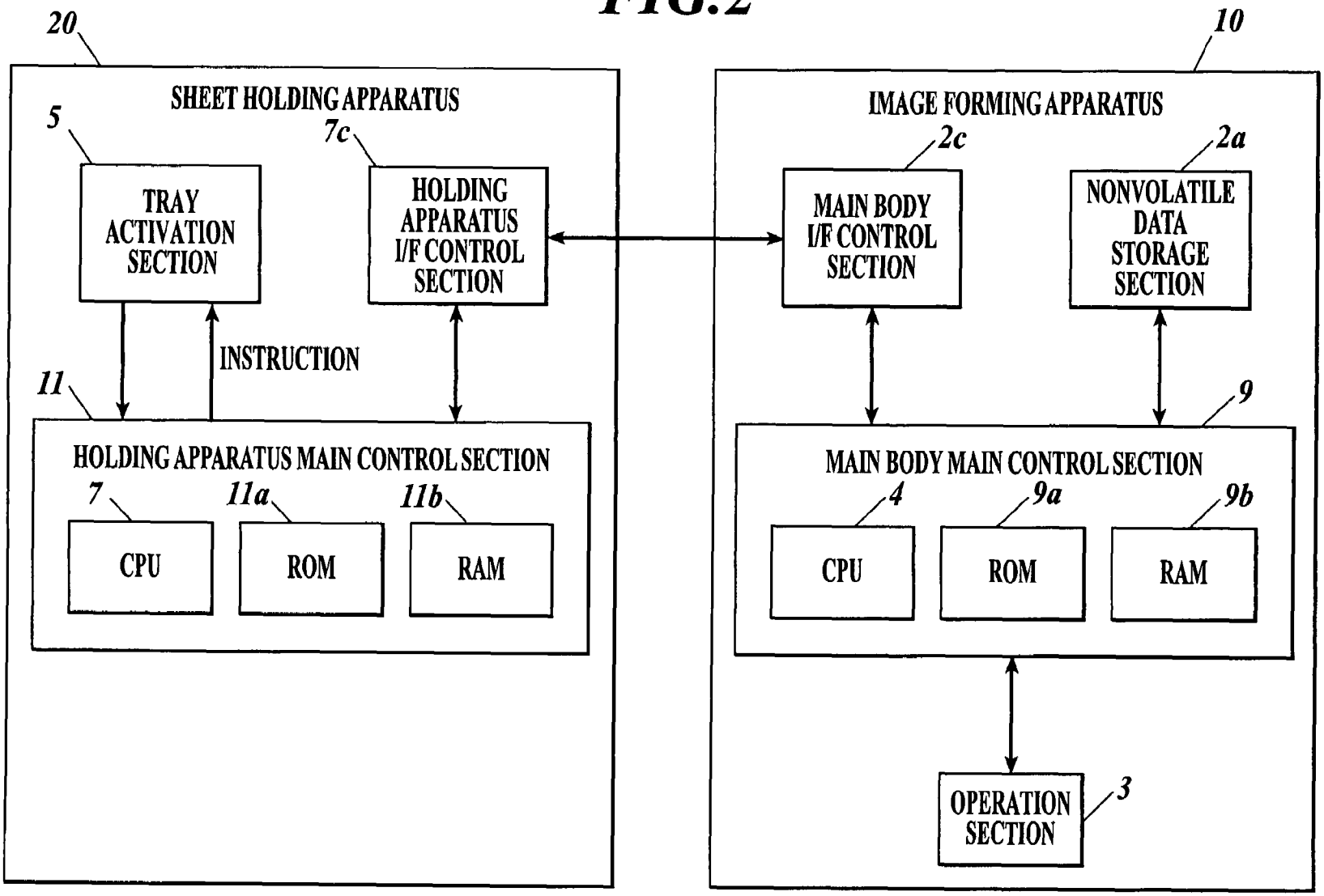
FIG. 2 illustrates a block diagram of the electrical configuration of the image forming system.
Figure 3:
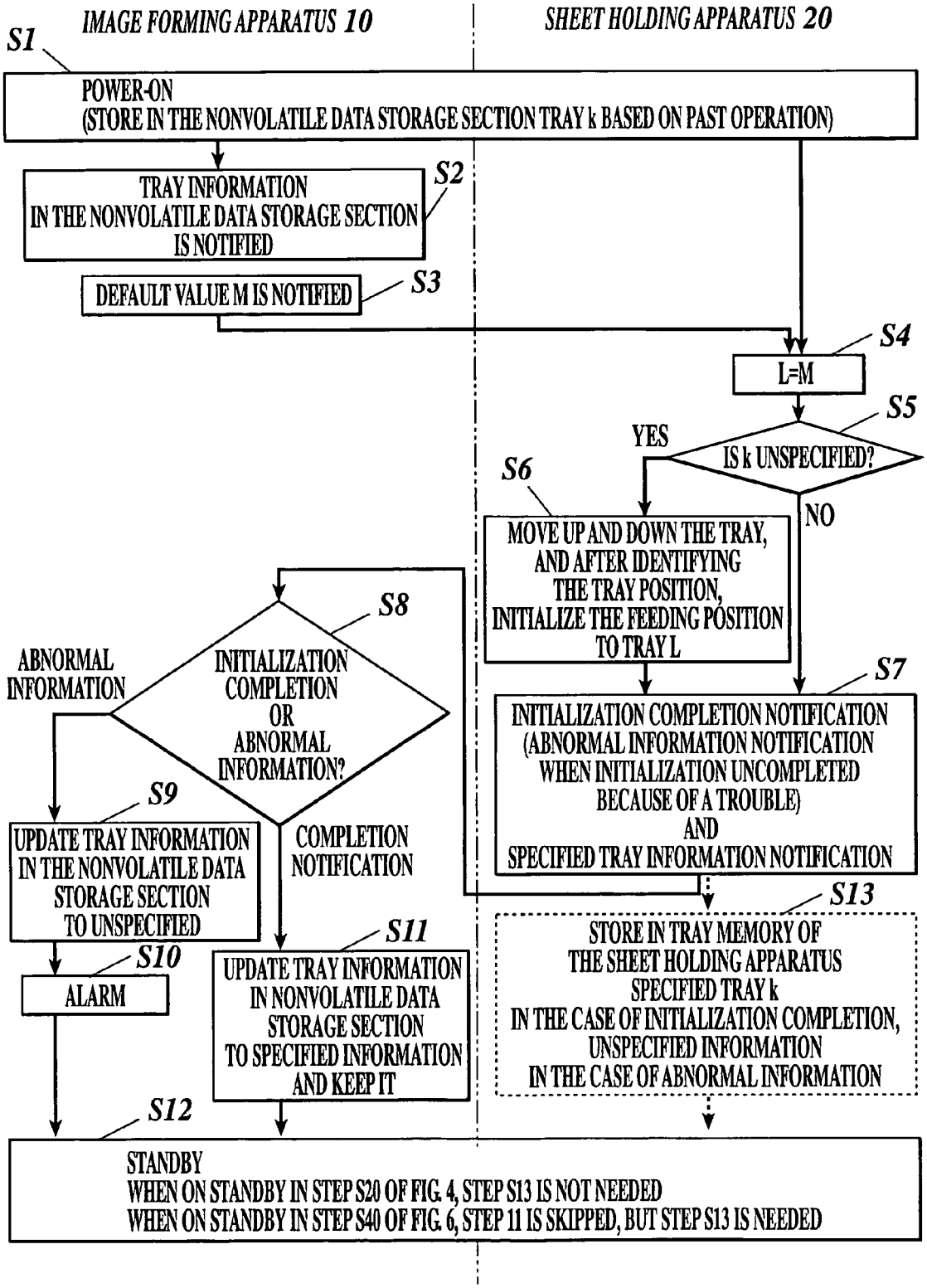
Figure 4:
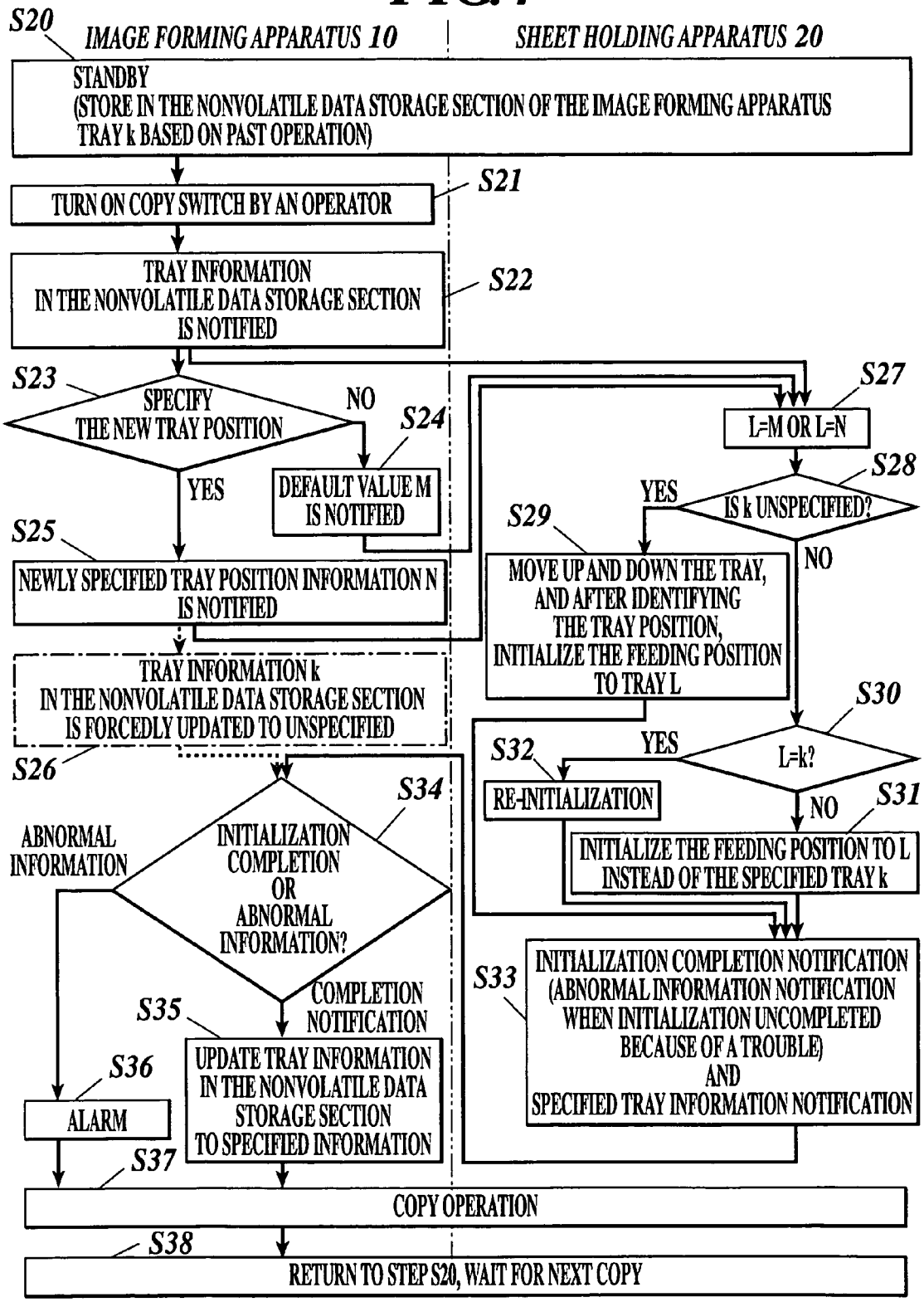
Figure 5:
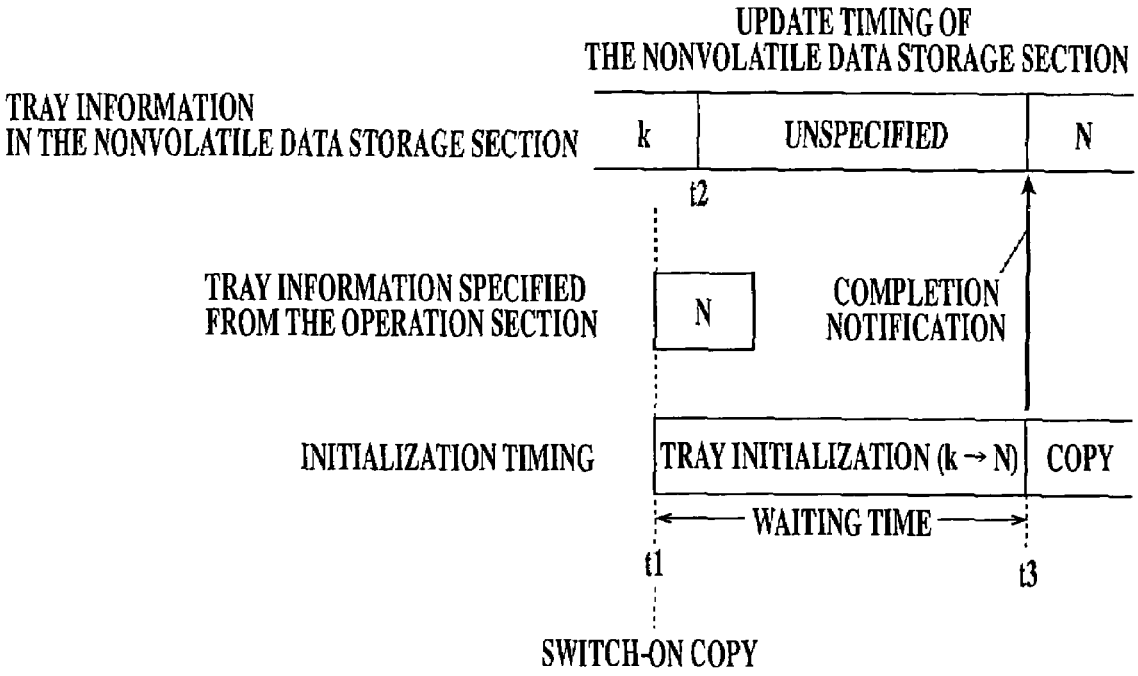
FIG. 5 illustrates an update timing of stray information which is stored in a nonvolatile data storage section 2*a*.
Figure 6:
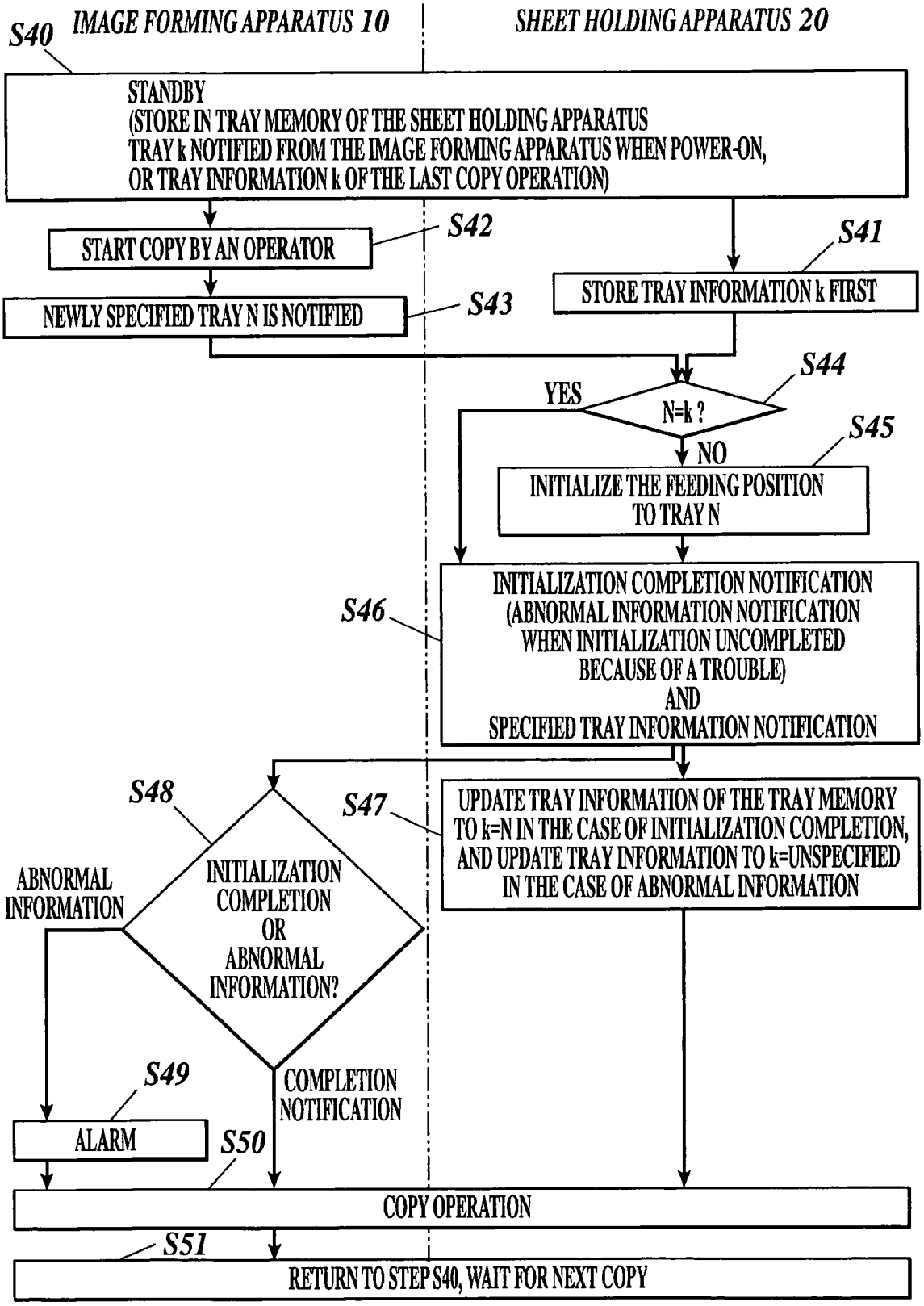

Embodiments of the invention are explained hereinbelow with reference to FIGS. 1-6. FIG. 1A and FIG. 1B illustrates a configuration of a sheet holding apparatus 20 and an image forming apparatus 10. FIG. 2 is a block diagram which explains an electrical structure of the apparatus 10 and 20. FIG. 3 illustrates an initialization flow chart after electric power is turned on. FIG. 4 illustrates an initialization flow chart after the copy switch is turned on. FIG. 5 explains the update timing of tray information which is stored in a nonvolatile data storage section 2*a*. FIG. 6 illustrates other exemplary initialization flow chart after the copy switch is turned on. FIG. 4 illustrates a first embodiment, and FIG. 6 illustrates a second embodiment which is to be explained later.

Referring to FIG. 1A and FIG. 1B, an image forming system mainly comprises the image forming apparatus 10 and the sheet holding apparatus 20. The image forming apparatus 10, may be a printer, a copy machine, a facsimile machine, or a multifunction apparatus which has the functions of at least two of the above apparatus. In the embodiment, the image forming apparatus is a copy machine. The image forming apparatus 10 has an image forming section 1, a document conveying section 100, and a reading section 103. The reading section 103 reads out the document conveyed by the document conveying section 100 and generate image data. The image forming section 1 forms an image on a sheet held in a sheet tray 1*a* (comprising 1*a*-1, 1*a*-2 and 1*a*-3), and then delivers the sheet to the sheet holding apparatus 20. The sheet holding apparatus 20 receives a sheet whereon an image has been formed by the image forming apparatus 10, and holds the sheet in a desired manner, for example, by number of copies.

The sheet holding apparatus 20 is explained hereinbelow.

The sheet holding apparatus 20 is equipped with a sheet delivery mechanism 4, a feeding section 8, a tray activation section 5 and a tray section 22. As shown in FIG. 1A and FIG. 1B, the sheet delivery mechanism 4 receives a sheet delivered from a sheet discharging opening 104 located at a predetermined position of the image forming section 1 of the image forming apparatus 10, and then transfers the sheet to a registration tray 8*a* of the feeding section 8 by rolling a transfer roller 4*a*, and holds it.

As shown in FIG. 1A, on the right end of the registration tray 8*a* disposed is a barrier for jogging a plurality of sheets. Sheets held in the registration tray 8*a* are delivered by the rolling of the transfer roller 8*b*, and supplied from a feeding position (dotted line position in FIG. 1A) of any one of trays 1*t*, 2*t*, 3*t* of the tray section 22.

Next, explained are the tray section 22 for eventually holding in a sheet whereon an image has been formed, the tray activation section 5 for moving each tray of the tray section 22, and each component of the activation section 5.

A saddle tray 21 is a tray which holds a sheet which has been folded, and which moves up and down until reaching a sheet feeding position when being set as the holding destination tray of the sheet whereon an image has been formed.

The tray section 22 comprises a plurality of trays that are stacked vertically, for example, trays 1*t*, 2*t* and 3*t* as shown in FIG. 1A. The trays 1*t*, 2*t* and 3*t* are spaced to each other forming a shelf-like structure and are attached to a moveable stand (not shown in the figure). The entire tray section 22 is made up-and-down moveable by activating the movable stand 5 with the activating section 5*e* (the movable stand and the activating section are included in the tray activation section 5). Inside the tray activation section 5 of FIG. 1A, a guide mechanism, while not shown in the figure, is set up between the tray section 22 and the activation section 54 for supporting and moving up and down the movable stand whereto the tray section 22 is attached.

In addition, the tray activation section 5 has a sensor (when explaining a sensor in general, a symbol is not attached after the term of sensor) for detecting the tray position. A tray upside detection sensor Sa detects if the upside of a tray (when explaining a tray in general, a symbol is not attached after the term of tray) has come to the feeding position, and is used especially to adjust the upside of the tray precisely to the feeding position. A tray position detection sensor 5*b* detects the traverse of a tray when the tray moves up and down, and detects which tray is in the feeding position. A tray low limit detection sensor 5*c* is a sensor which detects the lowest position that especially the tray 3*t* can move down.

Next, the electrical control of the image forming system in accordance with the invention is explained with reference to FIG. 2.

The image forming apparatus 10 comprises a main body major control section 9 having a CPU 4, a ROM 9*a* and a RAM 9*b*; a main body I/F control section 2*c*; a nonvolatile data storage section 2*a* and an operation section 3.

The CPU 4 executes in the working area of RAM 9*b* programs stored in the ROM 9*a*, and manages the entire control of the image forming apparatus 10. The ROM 9*a* stores various kinds of parameters for image formation in addition to programs for operation. The RAM 9*b* stores the image forming condition inputted from the operation section 3, and the post-processing condition of the holding tray of the sheet whereon an image has been formed. The main body I/F 2*c* inputs and outputs data (including information) between the sheet holding apparatus 20 and the image forming apparatus 10.

The sheet holding apparatus 20 comprises a holding apparatus main control section 11 having a CPU 7, a ROM 11*a* and a RAM 11*b*; a holding apparatus I/F control section 7*c*; and a tray activation section 5.

The CPU 7 executes in the working area programs stored in the ROM 11*a* and manages the entire control of the sheet holding apparatus 20. The ROM 11*a* stores programs for operating the CPU 7 and various kinds of control parameters of the sheet holding apparatus 20 such as a distance a tray moves. The RAM 11*b* stores information concerning a tray position inputted from the image forming apparatus 10 through the main body I/F control section 2*c* and post-processing conditions of a holding tray of a sheet whereon an image has been formed, and the like. The tray activation section 5 is controlled by the CPU 7, and so activated as to move up and down each tray of the tray section 22. The tray activation section 5 also has a mechanism which moves the above mentioned tray section 22.

Next, the operation of the image forming system will be explained.

In the embodiment, the CPU 4 of the sheet holding apparatus 20 determines the necessity/unnecessity of the initialization of the following (1)-(3) and/or the initialization content, and uses each of the above mentioned sensors to control the trays. (1) Explained here is an initialization operation by moving up and down a specified tray to the feeding position when the tray position before the initialization is in an unknown state where the tray position cannot be specified (hereinafter referred as unspecified). First, because the initial tray position is unknown, the tray section 22 is moved down temporally, the tray 3*t* is detected by the tray low limit detection sensor 5*c*. After the tray 3*t* is identified (at least the tray position can be identified at this stage, which is referred as identifying operation), the tray section 22 is moved up. While the tray section 22 is being moved up, if the detection signal from the tray position detection sensor 5*b* is inputted once, it is determined that the tray it has come to the feeding position; if the detection signal is inputted twice, it is determined that the tray 2*t* has come to the feeding position; if the detection signal is inputted twice, it is determined that the tray 2*t* has come to the feeding position; if the detection signal is inputted thrice, it is determined that the tray 3*t* has come to the feeding position. Therefore, if the specified tray is 2*t*, and after it is detected by the tray low limit detection sensor 5*c*, and if the tray position detection sensor 5*b* detects twice, then it is determined that the tray 2*t* has come to the feeding position. In this way, even the tray position is unspecified at first, the traverse of the tray is detected when the tray moves up and down, and the tray position can be identified. In this way, when the tray position is unspecified, the initialization is done by moving up and down bi-directionally in the above described manner.

The specified tray is a tray which, after initialization, should be arranged in a specified position, for example, the feeding position, and which is set appropriately taking into account the layout of the apparatus or the ease-of-use. On image formation, when a specified tray is specified as the holding destination of a sheet whereon an image has been formed, e.g. when the tray 2*t* is specified as the holding destination of a sheet whereon an image has been formed, the tray 2*t* is moved to the feeding position instead of a pre-set tray.

(2) Now explained is the case where the initial tray position of pre-initialization is known and can be identified, and when the tray specified by the operation section 3 is moved to the feeding position, or when a predetermined tray is moved to the feeding position. For example, as shown in FIG. 1A, if it is known that the tray it is in the feeding position, and when the tray 2*t* is specified as the holding destination tray of a sheet whereon an image has been formed, the initialization is carried out by moving up the tray section 22. At this time, if the tray 2*t* is stopped when the tray position detection sensor 5*a* inputs a detection signal once, then the tray 2*t* is set to the feeding position. In the case where the tray 3*t* has been specified, the tray section 22 is moved up, and if the tray position detection sensor 5*b* inputs a detection signal twice, then the tray 3*t* is set to the feeding position. Likewise, in the case where a predetermined tray is moved to the feeding position, it works in exactly the same manner. Of course, if it is known that the tray it in the feeding position and the tray 1*t* has been specified, it is unnecessary to carry out an up-and-down operation for the purpose of identifying operation. When a predetermined tray is the tray 1*t*, and it is known that the tray 1*t* is in the feeding position, then it is also unnecessary to carry out an up-and-down operation. If, initially, it is known that the tray 2*t* is in the feeding position and the specified tray is the tray 1*t*, the tray section 22 is moved down, and if the tray position detection sensor 5*b* inputs a detection signal once, then the tray it is determined to have come to the feeding position.

That is to say, in the case where the tray position of pre-initialization is known, the up-and-down operation is unidirectional, and the desirable tray is moved to the feeding position so as to be able to be set from the unidirectional direction and the number of times the detection signal is outputted by the tray position detection sensor 5*b*. Therefore, in this case, the up-and-down operation is unidirectional, so the moving distance is short, enabling the operational time to be shortened, and enabling the noise to be reduced.

In the present embodiment, while the term of initialization means to place a specified tray or a predetermined tray in the feeding position, it may also mean to place a specified tray in a known position which is different from the feeding position. This is because if it is in the known position, it can be placed in the feeding position during a copy operation.

In this way, each tray is made settable to a predetermined position, for example, to the feeding position. However, as described above, because the cooperative mechanical operation among the activation section 5*e*, the movable stand for bearing trays and the guide mechanism for supporting and guiding the movable stand in a movable manner; and because the tray upside detection sensor 5*a* has a distance detection range, for example, when a tray is moved down from upside and set in the feeding position or is moved up from downside and set in the feeding position, there are times when a backlash may occur.

Therefore, (3) as described above, if it is known that the initial tray 1*t* is in the feeding position and the specified tray is the tray 1*t*, for example, after having been moved up and set in the feeding position, the tray it is temporally moved up to just exceed the tray upside detection sensor 5*a*, and afterwards is moved down (in the gravitational direction). After being detected, the tray it is stopped by the tray upside detection sensor 5*a*. By controlling in this manner, the position variation resulting from each time setting a tray to the feeding position is reduced, consequently, the reproducible precision of the setting is increased. In this case, the up-and-down moving distance is almost imperceptible, causing the time used to pass the distance to be imperceptible, and there is almost no presence of noise.

While the above explanation is aimed at describing that each sensor detects a tray position corresponding to an individual purpose, the sensor may detect a tray either directly or indirectly. For example, such a configuration is allowable in which a tray low limit detection actuator 5*d* is attached to the movable stand, and when the movable stand, while being lowered, has been detected by the tray low limit detection sensor 5*c* in which case it may be regarded as the tray 3*t* has been detected at the low limit position. In addition, each sensor detection method or the way as such it detects, either mechanical contact or optical noncontact is applicable.

The holding apparatus main control section 11 in FIG. 2, when the electric power of the image forming system is turned on, or when the image formation begins, manages and controls the tray activation section 5 and the tray section 22, executes the above up-and-down operation to carry out the initialization. In the embodiment, when the image formation begins means when the copy machine is turned on, or just after the copy machine is turned on, and before the actual image formation operation (copy operation). However, if the image formation apparatus 10 can also function as a printer, it may mean that on receiving a command for printing, or just after a command for printing is received, and before the actual image formation operation (print operation). In addition, if the image formation apparatus 10 can also function as a facsimile machine, when the image formation begins means when the facsimile machine receives a transmission, or just after the facsimile machine receives a transmission and before the actual image formation.

The holding apparatus I/F 7*c* is an interface for exchanging information or signal with the image forming apparatus 10. Examples of the information or signal received from the image forming apparatus 10 by the holding apparatus I/F 7*c* are: a power-on signal of the image forming system; a switch-on signal of the copy machine; tray information which is set during a recent image formation (hereinafter referred as copy) when the electric power is turned on; tray information which is newly chosen (set) by the operation section 3 when the copy switch is turned on. Examples of the information sent to the image forming apparatus 10 by the holding apparatus I/F 7*c* are: the completion notification sent to the image forming apparatus 10 when the initialization of the tray section 22 has been completed; the abnormal information notification showing that it is abnormal when a trouble occurs, causing the initialization to be uncompleted during the initialization of the tray section 22.

On turning on electric power, the CPU 7 receives from the image forming apparatus 10 the tray information (the information stored in the nonvolatile data storage section 2*a* which is to be explained later) which has been set as the holding destination of a sheet during a recently executed copy operation, and determines if the tray information specifies the tray. If the determining result is that the tray is not specified, the CPU 7 will regard the tray position as being unspecified and will determine to perform the operation in the above (1). In that case, because the initial position of the tray is unspecified, as described in the above (1), the tray section 22 is moved down, and the tray 3*t* is detected by the tray low limit detection sensor 5*c*, which identifies the tray position. Afterwards, if the CPU 7 has set tray 2*t* as the default value, the tray section 22 is first moved up, and then stopped just after the tray position detection sensor 5*b* detects a tray twice. In other words, the initialization is carried out by taking the tray 2*t* to the feeding position.

If the determining result after electric power is turned on is that the tray can be specified from the received tray information, the up-and-down operation for the initialization will be determined to be unnecessary by the CPU 7 in which case the CPU 7 is on standby until the copy switch is turned on.

With the entire system being on standby, when the copy switch is turned on, the tray information of the holding destination of the sheet whereon an image is formed is determined by the CPU 7. In other words, at this time, the tray information (e.g. tray k) stored in the under mentioned nonvolatile data storage section 2*a* is first received from the image forming apparatus 10, when the tray of the holding destination of the sheet whereon an image is formed is specified from the operation section 3, the tray information (e.g. tray information N), when the tray of the holding destination of the sheet whereon an image is formed is not specified, the default value (tray M) is received. The CPU 7 determines if the tray k is unspecified, if unspecified, the tray is moved up and down as the above (1), and after the tray position is identified, the tray is operated so as to set either tray N or tray M to the feeding position. When the CPU 7 determines that the tray k can be specified, and further determines if k=N (or M) holds, when k=N (or M) holds, indicating the desirable tray N (or M) has come to the feeding position, the initialization is completed without moving up and down. Note, in order to output the setting accuracy, the operation in the above (3) may be carried out. When k=N (or M) doesn't hold, as in the above (2), instead of the tray k which has come to the feeding position, the tray N (or M) is controlled so as to come to the feeding position.

Next, the configuration of the image forming apparatus 10 is explained.

The holding apparatus main control section 11, in response to the requirements of an operator from the operation section 3, sets up and controls various conditions which are necessary to image forming, and has a nonvolatile data storage section 2*a* and a main body I/F 2*c*. The nonvolatile data storage section 2*a* stores tray information showing the most recent tray position: e.g. in the case of a plurality of trays, the identification information on the tray in the feeding position (e.g. trays 1, 2 and 3 in FIG. 1); in the case of a trouble and the tray in the feeding position cannot be specified, the information showing the tray is unspecified; in the case of one tray, the information on if the tray is in the feeding position or if placed below the tray position detection sensor 5*b* of FIG. 2 or if unspecified.

The nonvolatile data storage section 2 is rewritable, and keeps the storage contents when the electric power is turned off, and can be, for example, a hard disk, a backup RAM, a flash memory, or the like. In the embodiment, the nonvolatile data storage section 2*a* of the image forming apparatus 10 stores the most recent tray position among the past operation, and by using the stored tray information on next initialization, it is aimed at reducing standby time.

The CPU 4 instructs and manages so that the tray information is stored in a predetermined area of the nonvolatile data storage section 2*a*, and writes in the tray information of the initialization when receiving the initialization completion notification from the CPU 7 (the previous content is, when present, updated). When receiving abnormal information that indicates it is abnormal because the initialization is uncompleted due to a trouble, the unspecified information is written in (the previous content, when present, is updated). In addition, when the tray N specified by the operation section 3 is present prior to initialization, and the initialization has been completed exactly in that way, after receiving the initialization completion notification, the tray information of the nonvolatile data storage section 2*a* may be updated to the tray N which is stored in the RAM 9*b* and which is specified by the operation section 3.

The main body I/F 2*c* communicates with, and has the same function as the holding apparatus I/F 7*c*. The main contents sent to the holding apparatus F/F7*c* by the main body are: the power-on signal of the image forming system; the switch-on signal of the copy switch; the tray information that is set during the recent image formation (If the default value of the tray position is present in which case the value is included); the tray information that is newly set upon turning on the copy switch.

The content of the nonvolatile data storage section 2*a* is updated by the CPU 4 according to the timing shown in FIG. 5. In other words, for example, the information on a tray k (k is a specified value) is stored in the nonvolatile data storage section 2*a* before the power-on, when the copy switch is turned on (at time t1) and if the desired tray is set to a tray M by the operation section 3, at the time t2 after the tray M is informed to the holding apparatus I/F 7*c* by the main body I/F 2*c*, the instruction section 2*a* then write in the nonvolatile data storage section 2*a* unspecified information, at the next time t3, when the completion notification, which says the initialization has been completed, is received from the CPU 7, the unspecified tray information in the nonvolatile data storage section 2*a* is updated to the tray M which can be specified, and in the case where the completion notification is not received, the unspecified information is managed so as to be kept unchanged. In addition, the unspecified information is stored and when to keep the unspecified information unchanged in which case the concept of update is contained. In this way, when a trouble occurs during initialization, for example, in the case where the sheet holding apparatus 20 is detached from the image forming apparatus 10, and next, when the sheet holding apparatus 20 is connected and the copy task is started, the initialization of the above (1) can be done by reading out the tray information (unspecified) from the nonvolatile data storage section 2*a*. At least, the initialization can certainly be done without experiencing an out-of-control operation. Likewise, the unspecified information is stored in the nonvolatile data storage section 2*a*, when the CPU 4 receives abnormal information which says the initialization is not completed.

Next, referring to FIG. 3, a series of initialization operation after electric power is turned on is explained. While some parts of the following may overlap the above explanation, the operation flow is here focused on.

Each step in the flow chart of the FIG. 3 is explained hereinbelow.

Steps S1-S3: The power is turned on (step 1). At this time, the tray k based on the past operation is stored in the nonvolatile data storage section 2*a*. The tray information and the default value M, when present, are notified to the CPU 7 by the main body I/F 2*c* (step 2, step 3). Step S4: The CPU 7 makes L=M (a processing for the convenience of operation by software). Step S5: The CPU 7 checks if the tray k is unspecified. In other words, that if the tray information k is about none of the plurality of trays or about any one of the multiple trays is determined.

Step S6: When the tray k is unspecified, the initialization is carried out by the CPU 7 by moving the default tray L (=M) to the feeding position after moving up and down the section 22 to identify the tray position.

When k is a specified value, indicating the tray k has been already set to the feeding position, the CPU 7 then determines that it is unnecessary to operate (Step 5-NO). Step S7: The holding apparatus I/F 7*c* sends out the initialization completion notification in a predetermined time. When the initialization is completed, the holding apparatus I/F 7*c* further notifies the tray k (or M) to the image forming apparatus 10. When abnormal situation occurs because of a trouble, causing the initialization to be uncompleted, the holding apparatus I/F 7*c* outputs the abnormal information to the image forming apparatus 10. Step S8: The CPU 4 determines if a completion notification is received or an abnormal notification is received. Moreover, the CPU 4 can be configured to determine if the tray information arrived in a predetermined time, and if the tray information can be specified.

Step S9: In the case where the CPU 4 has not received the completion notification in a predetermined time, or in the case where the abnormal information has been received, or in the case where unspecified information is present in the received tray information, the content of the tray information in the nonvolatile data storage section 2*a* is updated as unspecified. Step S10: The image forming apparatus 10, when receiving abnormal information, outputs an alarm to a display section or the like, saying an abnormality has occurred. Step S11: When having received a completion notification and when having received tray k or M as the tray information, the CPU 4 updates the content of the nonvolatile data storage section 2*a* with that value (k or M). Step S12: On standby in a state of S20 of FIG. 4 or in a state of S40 of FIG. 6, until the next time when the copy switch is turned on.

In addition, the initialization after the copy switch is turned on is done following either flow chart of FIG. 4 (to be explained in the first embodiment) or flow chart of FIG. 6 (to be explained in second embodiment). The above explanation is explained following the flow chart of FIG. 4 where standby is made possible. When on standby in the flow chart of FIG. 6, the step S11 of FIG. 3 is skipped, instead of step 11, in step 13 the sheet holding apparatus 10 is provided with a memory made of a simple RAM (hereafter referred as tray memory (not shown in the figure) in order to differ with the nonvolatile data storage section 2*a*). When the initialization is completed, the initialized and specified tray information k is stored in the tray memory, when it is abnormal in which case the unspecified information is stored in the tray memory. Afterwards, go to step 40 of FIG. 6.

First Embodiment

Next, referring to FIG. 4, explained is the initialization flow chart after the copy switch is turned on. The flow chart of FIG. 4 is after the flow chart of FIG. 3. Step S20-S22: The copy switch-on is set in the standby state (steps S21, S22). At this time, the tray information k based on the past operation is stored in the nonvolatile data storage section 2*a*. The main body I/F 2*c* notifies the tray information k to the CPU 7 (step S22). Step S23: The main body determines if the new tray for the sheet to be copied has been set by the operation section 3.

Step S24, S25: When the new tray information has not been set by the operation section 3, the main body I/F 2*c* notifies the default value of M to the CPU 7 (step S24). When the new tray information has been set by the operation section 3, the main body I/F 2*c* notifies the tray N which has been set as the tray information to the CPU 7 (step S25). Step S26: After being notified by the main body I/F 2*c*, the CPU 4 forcibly updates tray k, which is the content of the nonvolatile data storage 2*a*, to be unspecified. Step S27: The CPU makes L=M or L=N (a processing for the convenience of operation by software). Step S28: The CPU 7 determines if the tray k is unspecified. Step S29: The CPU 7 initializes in such a way that the tray k is, when unspecified, moved up and down, and after the tray position is identified by an identification section, the tray L (M or N) is moved to the feeding position.

Step S30: When the tray k is a specified value, the CPU 7 determines if k=M (or N). Step S31: When the CPU 7 determines that k=M doesn't hold, instead of the tray k, which is in the feeding position, the tray M (or N) is moved to the feeding position. Step S32: When the CPU 7 determines that k=M (or N) holds, in principle, the tray is not moved. When setting precisely, like the operation in the above (3), a small displacement is done, and then re-initialization is carried out. Step S33: The holding apparatus I/F 7, when the initialization has been completed after receiving the tray information, sends out an initialization completion notification, and then notifies in combination with the tray L. When the initialization has not been completed, the abnormal information is outputted.

Step S34: The CPU 4 determines if a completion notification is received, or abnormal information is received. When the abnormal information has been received, but the completion notification has not been received, or the completion notification has been received but information which cannot be specified is present, the content of the nonvolatile data storage section 2*a* is kept the same as what is stored in the step S26. In other words, the tray information is unspecified. Step S35: When having received a completion notification and when having received tray k or M as the tray information, the CPU 4 updates the content of the nonvolatile data storage section 2*a* with that value (k or M). At this time, the CPU 4 can update the content of the nonvolatile data storage section 2*a* to be the tray N when the new tray N has been set in the operation section 3, or to be the tray M when the default value M has been set therein.

Step S36: When the abnormal information has been received, an alarm indicating it is abnormal is sent out without updating the tray information of the nonvolatile data storage section 2*a* (i.e. the unspecified state in step S26. It may be updated again to be unspecified). In addition, when the sheet holding apparatus 20 outputs neither a completion notification nor abnormal information in a predetermined time, the tray information is regarded as unspecified according to the tray setting information of step S26, allowing an effect which makes initialization possible on next image formation. Step S37: The main body main control section 9 executes the actual copy after the initialization is completed. The time until the initialization is completed is the copy standby time. Conventionally, the position identification of step S29 had to be carried out, causing the operation time to be long. However, in the invention, the initialization is carried out through steps S30-S31, or steps S30-S32, shortening the standby time and reducing the noise. Step S38: Return to step S20, and on standby until the next time when copy switch is turned on.

Second Embodiment

Next, referring to FIG. 6, the initialization flow chart after the copy switch is turned on is explained as another embodiment of FIG. 4. The flow chart of FIG. 6 is after the flow chart of FIG. 3. In this case, a tray memory (not shown in the figure) storing the tray information is on the side portion of the sheet holding apparatus 10. Steps S40, S41: When electric power is turned on, the tray k notified from the image forming apparatus 10 is first stored in the tray memory, and then on standby. Steps S42, S43: With the copy switch being turned on by an operator, the tray information N specified newly by the main body I/F 2*c* is notified to the sheet holding apparatus 10. Step S44: The CPU 7 determines if N=k. If N=k, the up-and-down operation for the purpose of initialization is not carried out because the desired tray N has been set to the feeding position.

Step S45: If the CPU 7 determines that N=k doesn't hold, instead of the tray k, which is currently in the feeding position, the tray N is moved to the feeding position. Step S46: When the initialization has been completed after receiving the tray information, the holding apparatus I/F 7*c* sends out an initialization completion notification, and then notifies in combination of the tray information N. When the initialization has not been completed, abnormal information is outputted. Step S47: The CPU 7 updates the tray memory to be the tray information N when the initialization is completed, and updates the tray memory to be unspecified when abnormal information is outputted.

Step S48: The CPU 4 determines if the initialization completion notification has been received or otherwise abnormal information has been received. When the initialization completion notification has been received, then switch over to the copy operation. Step S49: When abnormal information has been received, the CPU 4 sends out an alarm stating that an abnormality has occurred. Step S50: The main body main control section 9 executes the actual copy operation after the initialization is completed. Step S51: Return to the state of step S40, and wait until the next time when the copy switch is turned on.

In the invention, the above FIGS. 3-6 are stored as programs, and executed by a CPU, making it possible to shorten the standby time and reduce the noise.

The present embodiment is configured in such a manner that the image forming apparatus 10, which knows a tray position of the last image forming operation and stores the tray position in advance. The sheet holding apparatus 20 receives the information about the tray position and determines whether to initialize the tray according to the information. When initializing, how and which tray to move up and down is then determined. In other words, when the tray position in the information about the tray position is the desired initialization position, the up-and-down operation is unnecessary. However, when the information on the tray position differs from the desired tray initialization position, the initialization is carried out by moving up and down the tray in the information about the tray position to the desired initialization position. When the information about the tray position is unspecified, the initialization is carried out by moving up and down the predetermined tray to the desired initialization position, after an up-and-down operation is carried out in order to identify the tray position. Such a configuration makes it possible to shorten the initialization time and suppress the noise coming from unnecessary initialization operation.

Although the invention has been explained according to the embodiments, it should also be understood that the invention is not limited to the embodiments and that various changes and modifications may be made to the invention from the gist thereof.

The entire disclosure of Japanese Patent Application No. 2004-106378 filed on Mar. 31, 2004 including specification, claims, drawings and summary is incorporated herein by reference in its entirety.

What is claimed is:

1. A sheet holding apparatus, comprising: a feeding mechanism to feed a sheet having an image formed thereon by an image forming apparatus, from a predetermined feeding position;

a plurality of trays to contain the sheet fed from the feeding position;

a driving mechanism to move the plurality of trays up and down;

a receiving section to receive a tray information indicating a tray which has been at a feeding position in a prior operation; and an initialization control section to perfonn initialization operation by making a determination about necessity or unnecessity of initialization on the basis of the tray information received by the receiving section and by controlling the driving mechanism so that a predetermined tray is sittiated at the feeding position according to a result of the determination, wherein the initialization operation includes a first initialization operation to move the predetermined tray by a first distance and a second initialization operation to move the predetermined tray by a second distance which is shorter than the first distance; and the initialization control section performs the first initialization operation when the tray information is an unspecified information which cannot specify a tray.

2. The holding apparatus of claim 1, wherein the initialization control section performs the second initialization operation to move the predetermined tray by the second distance when a tray specified on the basis of the tray information is different from the predetermined tray.

3. An image forming system comprising: an image forming apparatus to form an image on a sheet, and a sheet holding apparatus to receive and contain the sheet having an image formed thereon by the image forming apparatus; the system further comprising:

a storage section to store an information with respect to a position of a tray in last operation;

a feeding mechanism to feed a sheet having an image formed thereon by an image forming apparatus, from a predetermined feeding position;

a tray to contain the sheet fed from the feeding position;

a driving mechanism to move the tray up and down; and an initialization control section to read out the information with respect to a position of a tray in last operation from the storage section, and determine whether an initialization operation for a position of a tray is performed, on the basis of the read out information with respect to a position of a tray, when electric power is turned on, wherein the initialization control section performs initialization operation by controlling the driving mechanism so that the tray is situated at the feeding position after the initialization control section moves the tray to a reference position once when the information with respect to a position of a tray is an unspecified information which cannot specify a position of the tray.

4. An image forming system comprising: an image forming apparatus to form an image on a sheet, and a sheet holding apparatus to receive and contain the sheet having an image formed thereon by the image forming apparatus; the system further comprising:

a storage section to store an information with respect to a position of a tray in last operation;

a feeding mechanism to feed a sheet having an image formed thereon by an image forming apparatus, from a predetermined feeding position;

a tray to contain the sheet fed from the feeding position;

a driving mechanism to move the tray up and down; and an initialization control section to determine whether to move the trays by the driving mechanism, on the basis of the information with respect to a position of a tray and the information with respect to a tray specified by the operator, at a beginning of an image forming operation, wherein the initialization control section performs no moving of the tray in a case that the information with respect to a position of a tray is an information indicating a tray which is at the feeding position, and the tray which is at the feeding position is the same as the tray which is specified by the operator.

* * * * *